US007624707B2

(12) United States Patent
LaRue

(10) Patent No.: US 7,624,707 B2
(45) Date of Patent: Dec. 1, 2009

(54) RE-ORIENTED OVER FIRE AIR PORTS FOR REDUCTION OF $NO_x$ PRODUCTION FROM PULVERIZED COAL-FIRED BURNERS

(75) Inventor: Albert D. LaRue, City of Green, OH (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 589 days.

(21) Appl. No.: 10/767,978

(22) Filed: Jan. 29, 2004

(65) Prior Publication Data

US 2005/0166867 A1 Aug. 4, 2005

(51) Int. Cl.
*F23D 1/00* (2006.01)

(52) U.S. Cl. ..... 122/4 D; 122/7 R; 110/251; 110/265

(58) Field of Classification Search ..... 122/4 D, 122/7 R; 110/251, 263, 265, 345, 347, 348
See application file for complete search history.

(56) References Cited

U.S. PATENT DOCUMENTS 3,048,131 A 8/1962 Hardgrove
5,205,226 A 4/1993 Kitto, Jr. et al.
5,329,866 A 7/1994 LaRue
5,809,913 A 9/1998 Kramer et al.
6,230,664 B1 * 5/2001 Janka et al. ..... 122/4 D

OTHER PUBLICATIONS

Steam/its generation and use, 40th Ed., Stultz & Kitto, Eds., © 1992 The Babcock & Wilcox Company, Chapter 13, pp. 13-6 to 13-11.

* cited by examiner

*Primary Examiner*—Jiping Lu
(74) *Attorney, Agent, or Firm*—Eric Marich

(57) ABSTRACT

An over fire air (OFA) port arrangement for a pulverized coal-fired boiler or furnace has at least one OFA port through each of the sidewalls for injecting OFA to increase residence time for each burner level. Plural OFA ports may be employed, staggered both vertically and horizontally to effectively deliver over fire air to the burner flames at the appropriate time and location to most efficiently reduce the formation of fuel $NO_x$. OFA port configurations for both single-wall and opposed-wall fired furnaces and boilers are provided.

14 Claims, 6 Drawing Sheets

RE-ORIENTED OVER FIRE AIR PORTS FOR REDUCTION OF $NO_x$ PRODUCTION FROM PULVERIZED COAL-FIRED BURNERS

FIELD AND BACKGROUND OF THE INVENTION

The present invention relates generally to the field of industrial and utility furnaces and boilers and in particular to new and useful over fire air (OFA) port configurations for a pulverized coal-fired furnace or boiler which effectively reduce $NO_x$ production.

$NO_x$ is an unintended byproduct from the combustion of fossil fuels, such as coal. Many industrial furnaces and boilers burn pulverized coal as a primary fuel. $NO_x$ emissions have been discovered to have a negative effect on the environment, and so they are now regulated substantially throughout the world.

Most $NO_x$ in furnaces and boilers burning pulverized coal is formed during combustion from the fossil fuel. This portion of $NO_x$ formation is called fuel $NO_x$. Fuel $NO_x$ is formed by oxidation of fuel-bound nitrogen during devolatilization and char burnout.

An effective method of reducing $NO_x$ production which has been known for many years is to reduce oxygen availability during the critical step of devolatilization. Oxygen availability can be reduced during devolatilization by removing a portion of the combustion air from the burners and introducing the air elsewhere in the furnace. This method is commonly referred to as air staging.

Over fire air (OFA) ports are typically used as part of such air staging systems in furnaces and boilers. The use of such OFA ports is disclosed, for example, in U.S. Pat. Nos. 3,048,131, 5,205,226 and 5,809,913. For a better understanding of such OFA systems, the reader is referred to *Steam/its generation and use,* $40^{th}$ Ed., Stultz & Kitto, Eds., Copyright© 1992 The Babcock & Wilcox Company, the text of which is hereby incorporated by reference as though fully set forth herein, and particularly to Chapter 13, pp. 13-6 to 13-11.

The effectiveness of over fire air in $NO_x$ suppression depends on the quantity of over fire air, the point in the burner flame where the over fire air is reintroduced, and the rate of reintroduction. Increasing the over fire air quantity tends to lower $NO_x$ levels from the burners, but continual increase of over fire air quantity will eventually cause $NO_x$ to increase as well. This results from combustion being displaced to a region of the furnace or boiler beyond the OFA ports.

The point at which over fire air is introduced into the furnace is critical as well, since the purpose of OFA systems is to enable the chemistry to proceed through a region of lower oxygen concentration in order to suppress $NO_x$ formation as hydrocarbons preferentially scavenge oxygen. Prematurely adding over fire air will negate the benefit as the desired chemistry is disrupted. And, the rate at which OFA is added is also important, so as to avoid creating oxygen-rich regions within the furnace. It is usual to gradually introduce over fire air to the combustion process to complete combustion without locally flooding the flames with oxygen. At the same time the OFA ports must be designed with sufficient jet momentum to penetrate and supply over fire air throughout the furnace enclosure.

FIGS. 1 and 2 illustrate a common prior art arrangement of burners and OFA ports and the resulting flame paths. The furnace enclosure 10 has three levels of burners 12, 14, 16. The enclosure 10 illustrated is typical of opposed-fired boilers; that is, burners 12, 14, 16 are oriented through both the front and rear walls 30, 32 of the enclosure 10, opposite each other. The uppermost level of openings through each of the front and rear walls 30, 32 of the enclosure 10 is comprised of OFA ports 20.

In FIG. 2, the approximate flame paths 13, 15, 17 generated by each row of burners 12, 14, 16 on the front and rear walls 30, 32 are displayed. Bottom burners 12 fire horizontally, and so flame paths 13 from the opposed burners 12 collide in about the center of the enclosure 10. Unburned combustibles and hot gases flow upwardly in a path 13*a* concentrated in the middle of the enclosure 10. Second level burners 14 are affected by the upward flow 13*a* of gases and combustibles, so that second level flame paths 15 from the opposed burners 14 bend upwardly near the middle of the enclosure 10. Third level burners 16 are even more affected by the upflow of gases 13*a*, and so the third level flame paths 17 from these burners bend upwardly even more quickly than second level flame paths 15.

As shown, the OFA air path 22 intersects the second and third level burner flame paths 15, 17 and approaches the upwardly flowing gases and combustibles 13*a*. This conventional OFA port configuration of FIGS. 1 and 2, while useful, provides greatly varying effects when OFA is injected into the enclosure 10. The effect on reduction of $NO_x$ is not consistent due to differences in residence time between the burners and the OFA ports, and differences in gas flow through the furnace resulting in different interactions of the OFA and flame paths, among other factors.

The OFA configuration illustrated in FIGS. 1 and 2, when used in a 600 MW utility boiler or furnace unit for example, will have a calculated bulk flow residence time from burners to OFA ports of 2.7 seconds for the bottom burners 12, 1.3 seconds for the second level burners 14 and only 0.6 seconds for the third level burners 16. Thus, the level 3 burners 16 suffer from insufficient residence time relative to the region of introduction of OFA, which tends to raise the level of $NO_x$ produced. Often, the most efficient method of reducing $NO_x$ emissions in this type of furnace is to disable the third level burners 16.

An alternative for increasing residence time for the second and third level burners 14, 16 is to increase the distance between the OFA ports 20 and the third level burners 16. However, this also requires additional space in the upper furnace region of the enclosure 10. Thus, increasing the OFA port 20 spacing requires a taller furnace enclosure 10, thereby increasing the costs and making a bigger building.

An OFA configuration which provides consistent minimum residence time between burner and OFA port but does not require a larger furnace or disabling existing burners is desirable. Further, an OFA port air flow which is better managed for each burner level is also desirable for reducing $NO_x$ emissions.

SUMMARY OF THE INVENTION

It is an object of the present invention to provide a novel arrangement of OFA ports for further reducing $NO_x$ in pulverized coal-fired furnaces and boilers.

Another object of the invention is to provide an OFA port configuration for improved residence time between the burners and OFA ports.

Accordingly, a furnace or boiler including the OFA system of the invention is provided in which over fire air ports are provided on the furnace enclosure sidewalls for introducing OFA transverse to the burner flame paths. An OFA port is optimally positioned to inject over fire air at each burner level flame path and provide good residence time. The air flow rate, air jet velocity and momentum are adjusted to produce maximum effectiveness and over fire air penetration into the furnace enclosure at the desired burner level flame path while avoiding increasing $NO_x$ production due to excess oxygen being present in higher burner levels.

A first OFA port arrangement is provided for an opposed-wall fired furnace or boiler having three burner levels. One OFA port is positioned to inject air at approximately the center of the enclosure where flames from the bottom burners meet. A pair of OFA ports are provided spaced vertically above and horizontally toward the front and rear wall to intersect approximately with the flame path of the second level burners. A second pair of OFA ports are provided a further distance above the first pair and closer to the front and rear walls for injecting OFA to intersect the flame paths of the third level burners.

An alternate configuration is provided for wide furnace enclosures in which some OFA ports are provided in the sidewall and others are located in the front and/or rear walls. The OFA ports are positioned through the sidewalls and spaced to direct the over fire air to intersect the flame paths from bottom level burners. OFA ports for injecting air into the flame path of the upper level burners, such as the second and third level burners in a three-high burner level arrangement, are located in the front and/or rear walls of the enclosure. Alternately, lower level OFA ports are positioned through the sidewalls and spaced to direct over fire air to intersect the bottom level burner flame path and upper level OFA ports are also positioned through the sidewalls to direct over fire air to intersect the second level burner flame path. OFA ports for injecting over fire air into the burner flame path of the third level burners are located on the front and/or rear walls of the furnace enclosure.

Another configuration is provided for single-wall fired furnaces and boilers in which burners are only positioned through the front wall. OFA ports are arranged in the furnace sidewalls in a generally diagonal line extending from the lower end of the furnace enclosure adjacent the rear wall toward the upper end of the enclosure adjacent the front wall. A number of OFA ports corresponding to or in excess of the number of burner levels are provided forming the diagonal line arrangement. The OFA ports are positioned to at least inject over fire air across the enclosure and generally into the flame path of each burner level.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
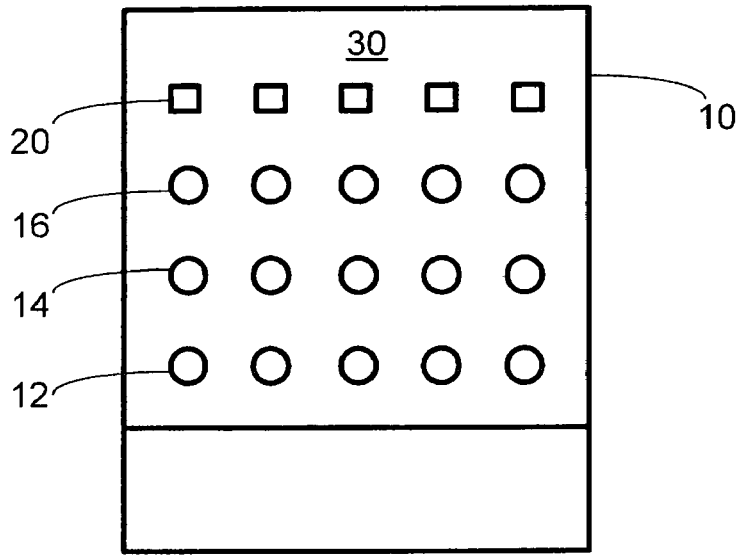
FIG. 1 (PRIOR ART)
FIG. 1 is a partial front elevation diagram of burner and OFA ports on a prior art furnace enclosure.
Figure 2:
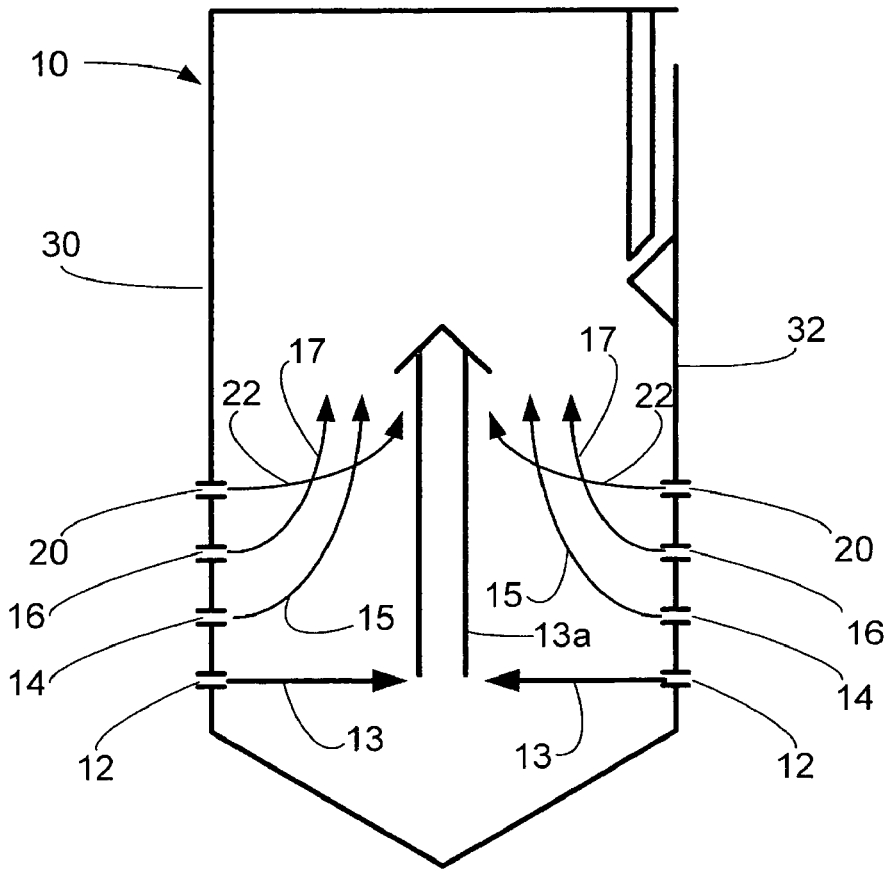
FIG. 2 (PRIOR ART)
FIG. 2 is a side elevation diagram of the prior art furnace enclosure of FIG. 1 illustrating flame paths in the furnace enclosure.

Referring now to the drawings, wherein which like reference numerals are used to refer to the same or functionally similar elements throughout the several drawings, FIGS. 3-6 each display a furnace enclosure 10 of an opposed-wall fired furnace including an OFA configuration of the invention. Like the enclosure 10 of FIGS. 1 and 2, in each of FIGS. 3-6, three burner levels 12, 14, 16 are located in the front and rear walls 30, 32, respectively. However, as will be appreciated by those skilled in the art, the present invention is applicable to single wall fired and opposed fired furnace enclosures 10 having fewer or a greater number of burner levels.

Figure 3:
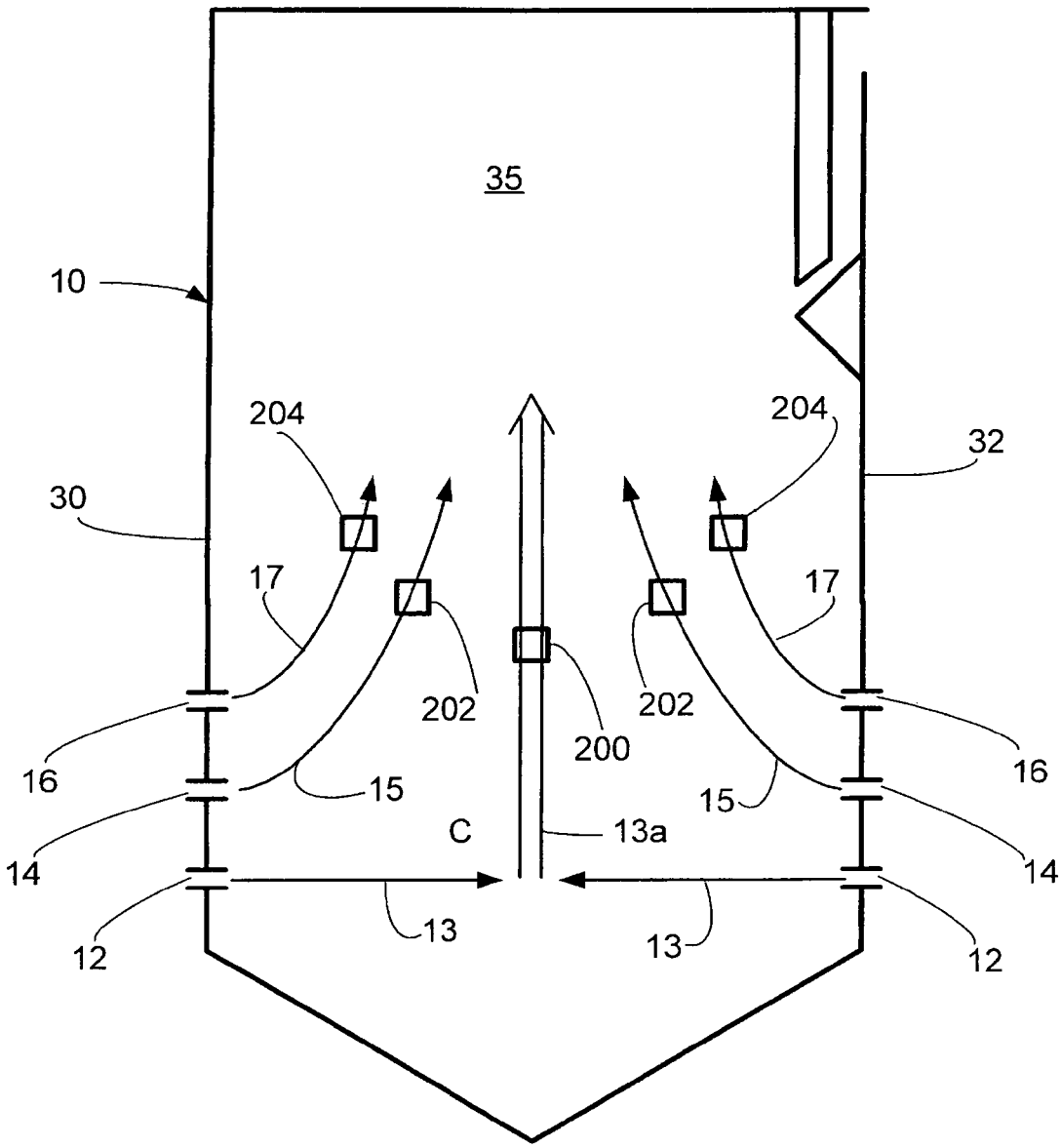
FIG. 3 is a side elevation diagram of a furnace enclosure having an over fire air port configuration of the invention.

In FIG. 3, over fire air ports 200, 202, 204 are located in sidewalls 35, rather than the front or rear walls 30, 32. The OFA ports 200, 202, 204 are positioned so that the injected air will generally transversely intersect the burner flame paths 13*a*, 15, 17, respectively. That is, bottom OFA port 200 will inject over fire air for the flames of the bottom burners 12, middle OFA ports 202 supply OFA for second level burners 14, and upper OFA ports 204 inject air for the burner flame of third level burners 16.

The OFA ports 200, 202, 204 are spaced vertically and horizontally, so that the bottom OFA port 200 is nearest the furnace lower end and center, while upper OFA ports 204 are closest to front and rear walls 30, 32 and nearest the furnace 10 upper end. The OFA ports 200, 202, 204 are arranged to best supply OFA to the cross-section of the furnace enclosure 10 and burn out combustibles in the burner zone. The quantity of over fire air, the air jet velocity and momentum are selected to ensure that the over fire air is thrust out into the furnace to ensure good mixing of the over fire air supplied via these ports 200, 202 and 204 with the burner flame paths 13*a*, 15 and 17.

The spacing is designed to deliver OFA to the burner flame paths at a time which minimizes $NO_x$ production. The vertical and horizontal spacing of the OFA ports 200, 202, 204 prevents undesirable interaction between the over fire air and the flame paths 15, 17 of the second and third level burners 14, 16. The staggered arrangement of OFA ports 200, 202, 204 avoids the problem of known OFA systems in which over fire air is supplied too soon to the flame paths 15, 17 of the upper level burners 14, 16. Thus, the transverse OFA supply configuration of the invention provides more efficient fuel $NO_x$ reduction.

While bottom OFA port 200 is shown elevated above the intersection of the bottom burner flame paths 13, it may be positioned lower to inject OFA more nearly at the intersection. The flames from the bottom burners 12 are expected to have proceeded through char reactions shortly after the flame paths 13 intersect. Thus, introduction of OFA near that point will not adversely cause more fuel $NO_x$ production.

The positions of OFA ports 200, 202, 204 may be adjusted to more accurately direct over fire air into the expected flame paths 13, 13*a*, 15 or 17. At the same time, the OFA port positions are set to provide sufficient residence time between the burners and the over fire air.

Figure 4:
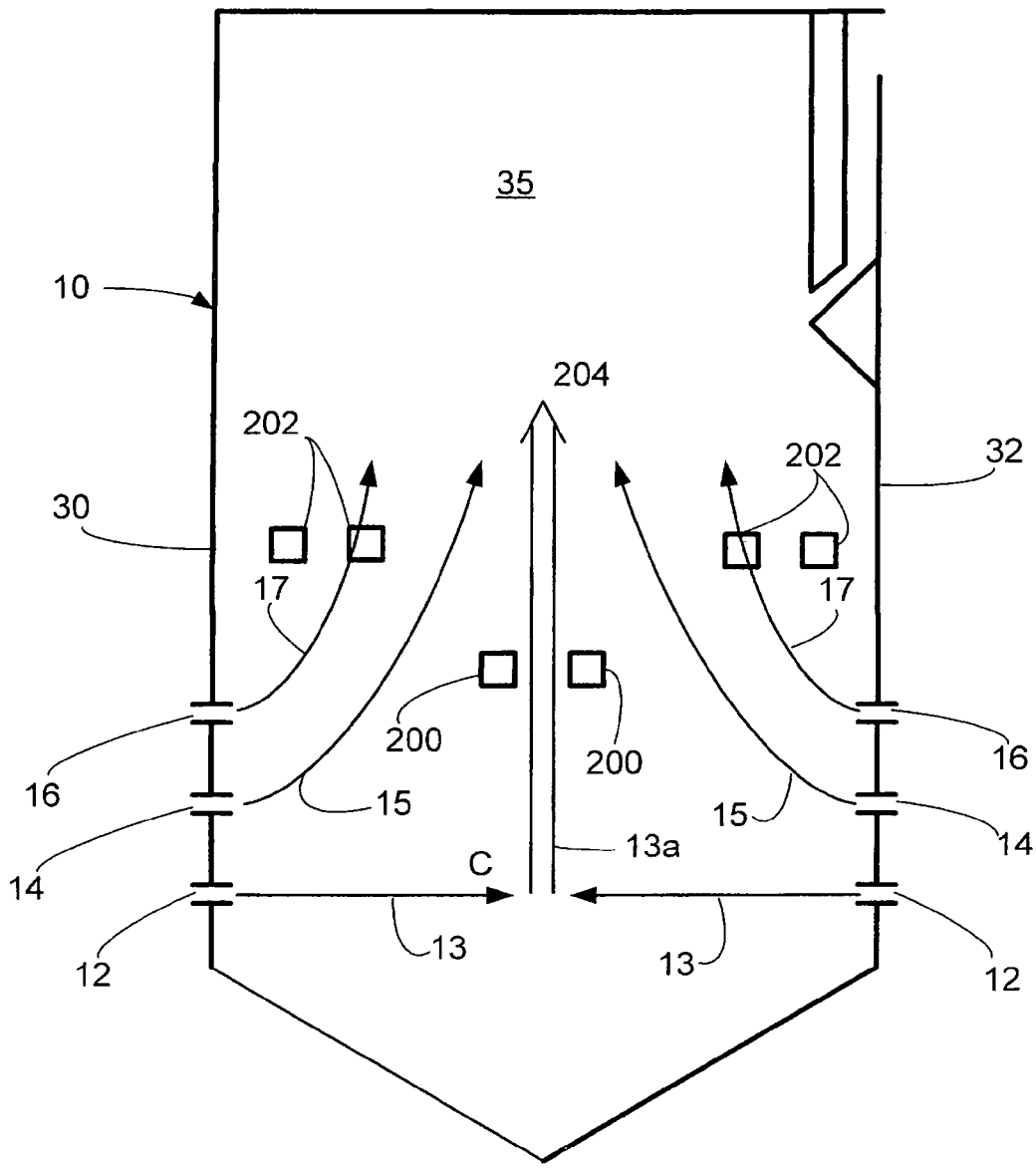
FIG. 4 is a side elevation diagram of an alternate embodiment of the over fire air port configuration of the invention.

For example, FIG. 4 illustrates an alternate OFA port configuration with only two levels of OFA ports 200, 202. The OFA ports 200, 202 are again staggered horizontally and vertically. However, the bottom OFA ports 200 are arranged substantially symmetrically about a vertical centerline (between the front and rear walls 30, 32) of the enclosure 10, and therefore, also about the flow of rising gases and combustibles represented by the burner flame path 13*a*. Middle OFA ports 202 are provided above and closer to the front and rear furnace walls 30, 32 than are the bottom OFA ports 200.

Figure 5:
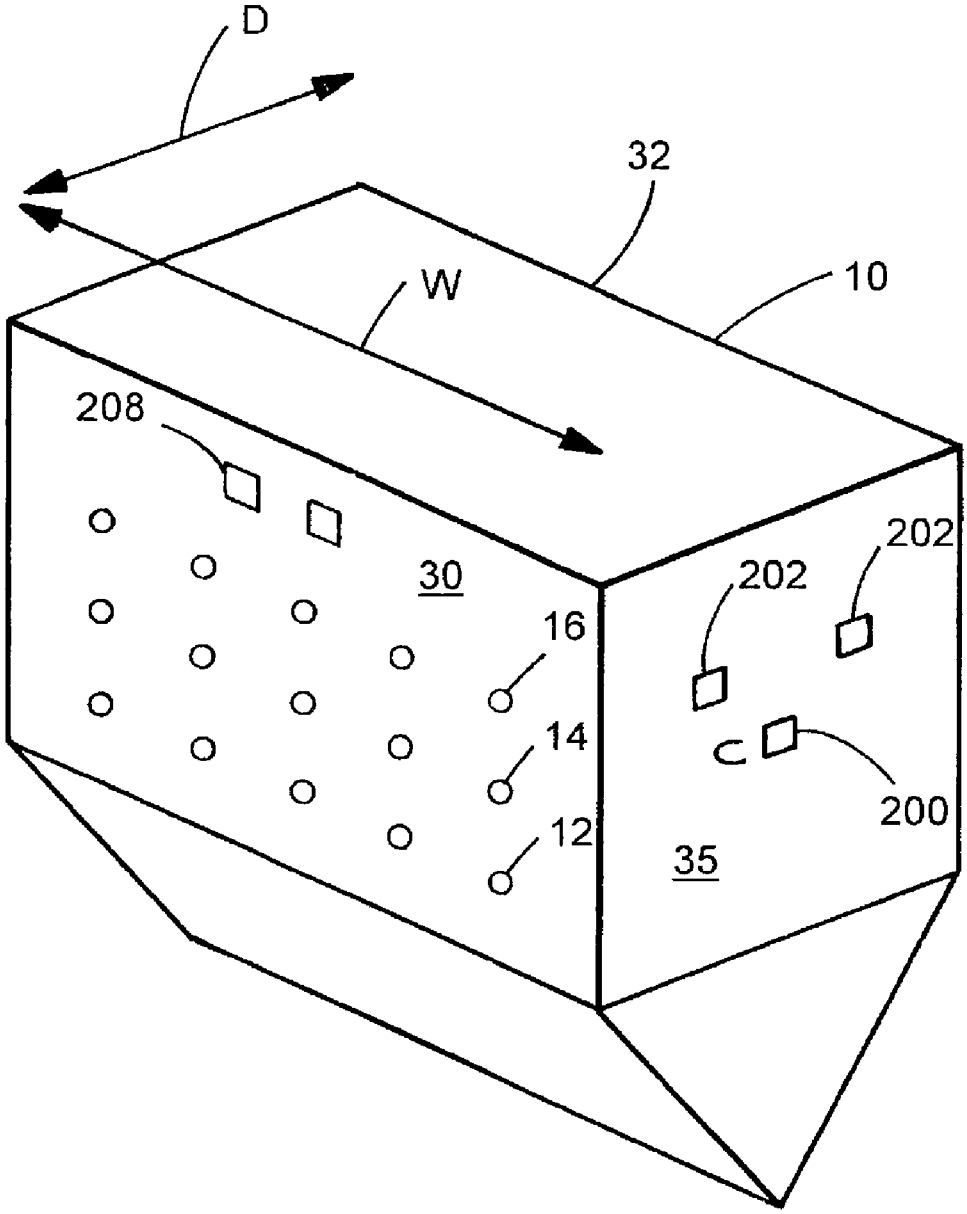
FIG. 5 is a partial perspective view of yet another embodiment of the over fire air port configuration of the invention.

The OFA port arrangement of FIG. 5 is best suited for use in furnaces 10 where the cross-sectional ratio of width (W) to depth (D) is approaching or exceeding 2, however it may be desirable to apply it to furnaces 10 where the furnace is physically wide (e.g., over 40 feet) regardless of width to depth ratios. OFA ports 200, 202 are located through both furnace sidewalls 35 for injecting over fire air transversely at the lower level burners 12, 14. In certain circumstances, only one OFA port 200 may be employed, substantially at the center of each of the sidewalls 35. If additional OFA ports 202 are employed, they would be arranged symmetrically about the OFA port 200, and at a somewhat higher elevation as shown and described. Additional OFA ports 208 are positioned near the centerline of the furnace front and rear walls 30, 32, at an elevation above the elevation of the uppermost row of burners 16. The particular number and placement of these OFA ports 208 can be determined by computational fluid dynamic (CFD) modeling techniques known to those skilled in the art. Generally, as the furnace width W begins to increase, since penetration of the over fire air into the centermost portion is desired, the first OFA ports 208 would be applied at approximately the centerline of the front and rear walls, 30, 32, and as furnace width W increased further (greater W/D ratios) additional OFA ports 208 would be employed, preferably substantially symmetrically on both sides of the centerline of the front and rear walls 30, 32. The front wall OFA ports 208 better direct OFA air into the center of the furnace enclosure 10 when the width begins to increase, than transversely oriented OFA ports alone can. The size of the OFA ports 200, or 208 are selected to ensure that an adequate quantity of over fire air, the air jet velocity and momentum are provided to ensure that the over fire air is thrust out into the furnace 10 to ensure good mixing of the over fire air supplied via these ports with the burner flame paths 13*a*, 15 and 17.

Figure 6:
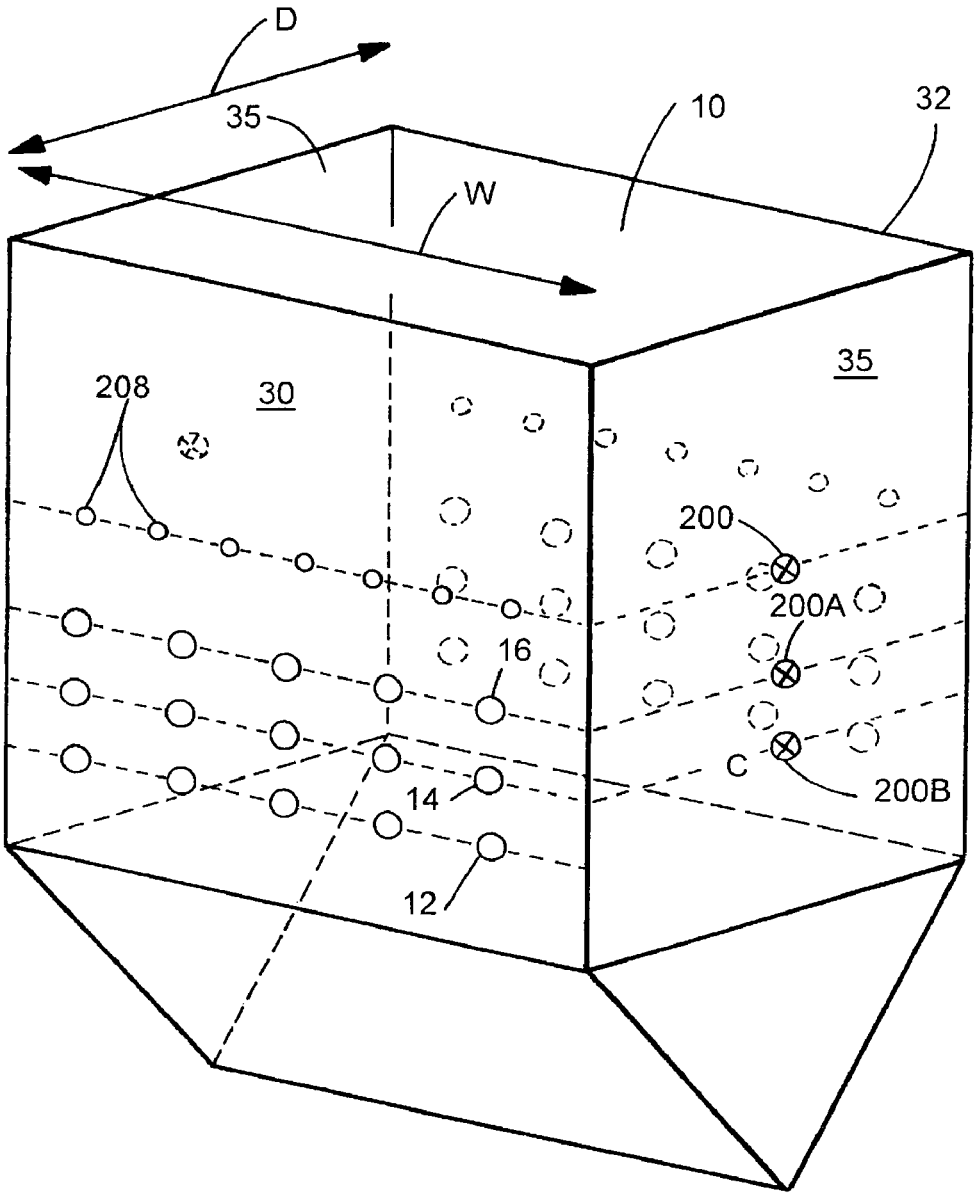
FIG. 6 is a partial perspective view of yet another embodiment of the over fire air port configuration of the invention.

In certain circumstances, it may be desirable to place OFA ports 208 so as to cover a more substantial portion of the width W of the front and rear walls 30, 32 even where the furnace 10 W/D ratios are at or close to 1, or even less than 1. FIG. 6 illustrates such an application to a furnace configuration where the W/D ratio is not much greater than 1, at least one OFA port 200 is employed on each sidewall 35, and a plurality of OFA ports 208 are employed so as to cover more than just a central portion of the furnace 10 and along furnace width W. The at least one OFA port 200 located on each of the sidewalls 35 is positioned at approximately the same elevation as those OFA ports 208 located on the front and rear walls 30, 32. These side wall OFA ports 200, in this embodiment, would typically provide approximately 30% of the over fire air, the balance being provided by the plurality of OFA ports 208 located in the front and rear walls 30, 32. Under certain circumstances, the at least one OFA port 200 on each sidewall 35 may be positioned at approximately the same elevation as the elevation of the top row of burners 16, as schematically and alternately shown in FIG. 6 by 200A, or even at a lower elevation approximately corresponding to a center C of the burner zone; i.e. at the elevation of the middle row of burners 14 in a three-level burner arrangement, as schematically and alternately shown in FIG. 6 by 200B.

Figure 7:
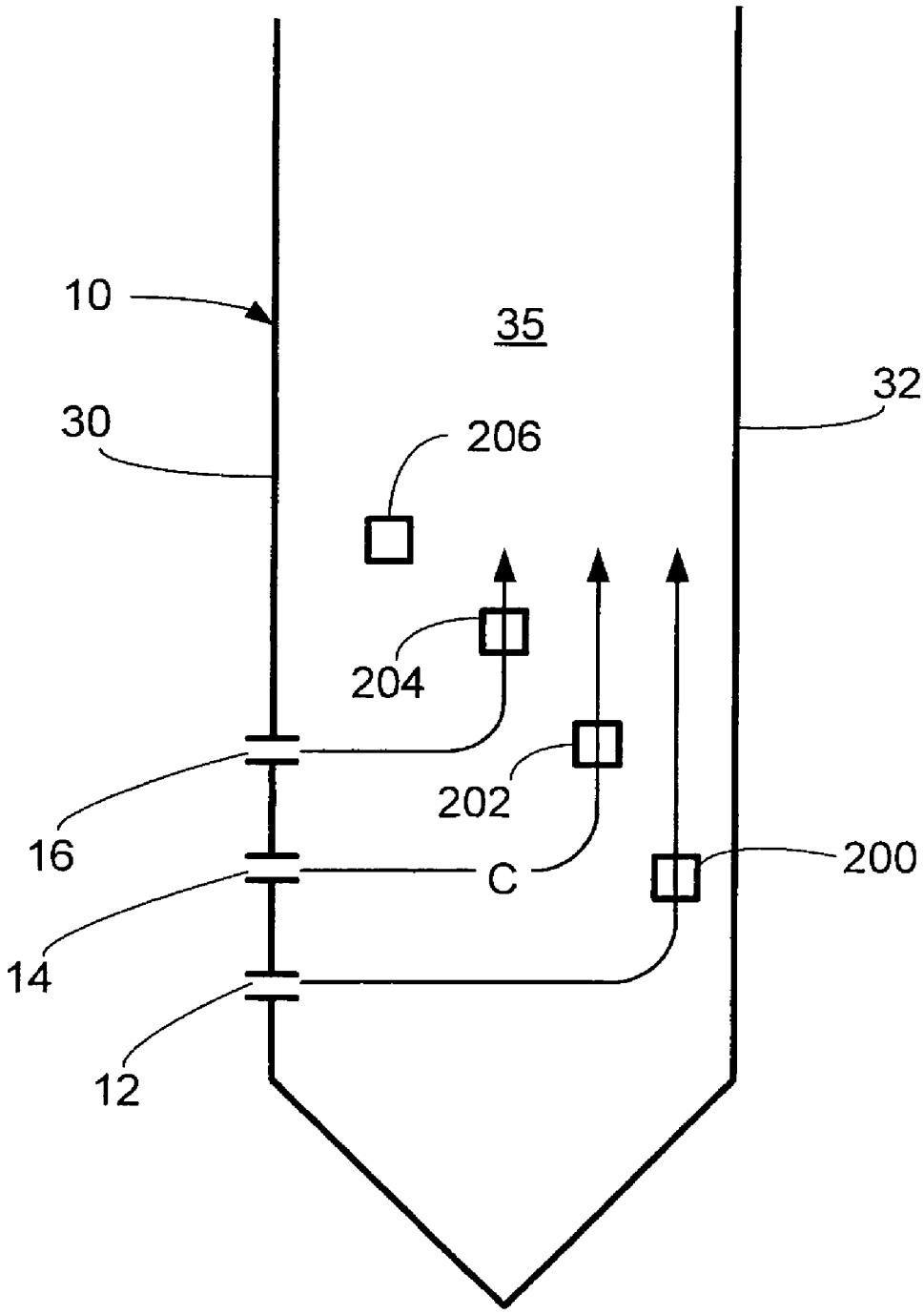
FIG. 7 is a side elevation diagram of an embodiment of the over fire air port configuration of the invention for a single-wall fired furnace or boiler.

FIG. 7 displays an alternate configuration of the OFA ports for use with a single-wall fired furnace in which burners 12, 14, 16 are provided only on the front wall 30 of the furnace enclosure 10. In this type of furnace, the flame paths are initially affected primarily by the presence of the rear wall 32. The flame paths 13, 15, 17 of the bottom, second and third level burners 12, 14, 16, respectively are indicated by the lines as shown.

OFA ports 200, 202, 204 and 206 are provided through enclosure sidewalls 35 to inject OFA. OFA ports 200, 202, and 204 are arranged to inject over fire air at the flame path of burners 12, 14, 16, respectively. OFA port 206 provides additional air nearest to the front wall 30 to ensure complete combustion of the fuel.

The particular number of OFA ports 200, 202, 204, 206, 208 provided at any given level can be changed to best deliver OFA to the selected region. For example, while FIG. 3 illustrates one bottom OFA port 200 and FIG. 4 illustrates two, three or more could be used if desired to ensure good combustion and coverage. As noted above, the primary consideration when arranging the OFA ports is to provide OFA to the correct flame path for a given level, thereby ensuring suitable residency time for each burner level.

The OFA configurations of the invention solve the problem of too rapid air introduction to the second and third level burners without requiring a taller furnace enclosure. The OFA configurations herein provide a more effective system for controlling $NO_x$ without disabling burner levels. These OFA configurations are an inexpensive design which allows tailoring the point of OFA introduction to the flame paths to best control $NO_x$ for a given type of furnace.

The OFA configurations of the invention also provide better control of air mixing so that flames from the upper level burners are not flooded with air too soon. The transverse orientation of the OFA ports in at least the lower levels permits good injection of the OFA to the bottom level burner flames without interfering with the second and third (or higher) level burner flames. The OFA can be injected in sufficient quantity from the sidewalls to produce good penetration and distribution into the desired flame path, without detriment to the other burner level flame paths. Accordingly, fuel $NO_x$ production remains reduced as the second and third level flames have sufficient time to burn before the introduction of OFA. Thus, air staging is made more effective by the transverse orientation of the OFA ports with respect to the burner levels. It is believed that the present invention will permit the percent of over fire air provided through the sidewalls to be within a range of about 20 to 100% of the total over fire air. The upper end of this represents a situation where all the over fire air is provided via the side wall OFA ports, while the lower end of the range represents a situation where over fire air is introduced by both side wall OFA ports according to the invention, and front and/or rear wall OFA ports.

While specific embodiments of the invention have been shown and described in detail to illustrate the application of the principles of the invention, those skilled in the art will appreciate that changes may be made in the form of the invention covered by the following claims without departing from such principles. For example, the present invention may be applied to new construction involving industrial or utility steam generators, boilers or furnaces, or to the replacement, repair or modification of existing industrial or utility steam generators, boilers or furnaces. In some embodiments of the invention, certain features of the invention may sometimes be used to advantage without a corresponding use of the other features. For example, the OFA ports may be employed on the sidewalls alone, or in combination with OFA ports on the front, or both of the front and rear furnace walls, depending upon the firing arrangement as described herein. Accordingly, all such changes and embodiments properly fall within the scope and equivalents of the following claims.

What is claimed is:

1. An over fire air port arrangement for a fossil fuel fired furnace or boiler, comprising:

front and rear walls and a pair of sidewalls forming a furnace enclosure;

vertically spaced bottom, second and third level burners through at least one of the front and rear walls generating bottom, second and third flame paths, respectively, in the furnace enclosure when burning fossil fuel; and an over fire air port arrangement configured to efficiently reduce fuel NOx formation during combustion in the furnace enclosure, the over fire air port arrangement including at least one bottom over fire air port through at least one sidewall appropriately sized and positioned to transversely and directly inject over fire air into the bottom flame path to provide sufficient residence time and mixing of the over fire air in the bottom flame path without interfering with the other flame paths; and at least one middle over fire air port through at least one sidewall, spaced vertically above and horizontally offset from the at least one bottom over fire air port and appropriately sized and positioned to transversely inject over fire air into at least one of the second and third level flame paths to provide sufficient residence time and mixing of the over fire air in the at least one of the second and third level flame paths without interfering with the other flame paths.

2. The over fire air port arrangement according to claim 1, further comprising at least one upper over fire air port through at least one sidewall, spaced vertically above and horizontally offset from the at least one middle over fire air port for transversely injecting over fire air into the third level flame path.

3. The over fire air port arrangement according to claim 1, further comprising at least one over fire air port through at least one of the front and rear walls, for injecting over fire air into the third level flame path.

4. The over fire air port arrangement according to claim 3, wherein the furnace enclosure has a cross-sectional width to depth ratio greater than about 1.

5. The over fire air port arrangement according to claim 3, wherein the at least one over fire air port through at least one of the front and rear walls is positioned substantially at the center of a width of the furnace enclosure.

6. The over fire air port arrangement according to claim 1, wherein the at least one middle over lire air port comprises plural over fire air ports adjacent to one another.

7. The over fire air port arrangement according to claim 1, wherein the at least one middle over fire air port comprises plural over lire air ports arranged substantially symmetrically about a vertical centerline between the front and rear walls.

8. The over fire air port arrangement according to claim 7, wherein the furnace enclosure has a cross-sectional width to depth ratio greater than about 1.

9. The over fire air port arrangement according to claim 1, wherein the over fire air ports are disposed on at least one sidewall in a substantially symmetrical downward arc, each over fire air port being spaced vertically above and horizontally offset with a corresponding burner so as to be in a transverse relationship with the flame path of the burner.

10. An over fire air part arrangement for a fossil fuel fired furnace or boiler, comprising:

front and rear walls and a pair of sidewalls forming a furnace enclosure;

vertically spaced bottom, second and third level burners through at least one of the front and rear walls generating bottom, second and third flame paths, respectively, in the furnace enclosure in an upward direction when burning fossil fuel; and an over fire air port arrangement efficiently reducing fuel NOx formation during combustion in the furnace enclosure, the over fire air port arrangement including at least one bottom over fire air port through at least one sidewall centrally positioned and appropriately sized to transversely inject over fire air into the bottom flame path to provide sufficient residence time and mixing of the over fire air in the bottom flame path without interfering with the other flame paths; and at least one middle over fire air port through at least one sidewall, spaced vertically above and horizontally offset from the at least one bottom over fire air port and appropriately sized and positioned above said burners to transversely inject over fire air into at least one of the second and third level flame paths to provide sufficient residence time and mixing of the over fire air in the at least one of the second and third level flame paths without interfering with the other flame paths.

11. The over fire air port arrangement according to claim 10, further comprising at least one upper over fire air port through at least one sidewall, spaced vertically above and horizontally offset from the at least one middle over fire air port for transversely injecting over fire air into the third level flame path.

12. The over fire air port arrangement according to claim 10, further comprising at least one over fire air port through at least one of the front and rear walls, for injecting over fire air into the third level flame path.

13. The over fire air port arrangement according to claim 12, wherein the furnace enclosure has a cross-sectional width to depth ratio greater than about 1.

14. The over fire air port arrangement according to claim 12, wherein the at least one over fire air port through at least one of the front and rear walls is positioned substantially at the center of a width of the furnace enclosure.

* * * * *